United States Patent [19]

Ickes

[11] 3,943,676

[45] Mar. 16, 1976

[54] MODULAR BUILDING WALL UNIT AND METHOD FOR MAKING SUCH UNIT

[76] Inventor: Gustav Ickes, Karlsbader Str. 1a, 6462 Gelnhausen-Hailer, Germany

[22] Filed: Mar. 15, 1974

[21] Appl. No.: 451,928

[30] Foreign Application Priority Data

Dec. 24, 1973 Germany ..... 2364571

[52] U.S. Cl. ..... 52/309; 52/596

[51] Int. Cl.² ..... E04C 2/26

[58] Field of Search ..... 52/309, 612, 413, 600, 52/596, 173 R

[56] References Cited

UNITED STATES PATENTS

| | | | |
|---|---|---|---|
| 2,175,070 | 10/1939 | Turco | 52/391 |
| 3,292,331 | 12/1966 | Sams | 52/309 |
| 3,305,991 | 2/1967 | Weismann | 52/309 |
| 3,309,827 | 3/1967 | Nicosia | 52/309 |
| 3,332,187 | 7/1967 | Arcari | 52/309 |
| 3,449,879 | 6/1969 | Bloom | 52/309 |
| 3,552,076 | 1/1971 | Gregori | 52/309 |
| 3,775,240 | 11/1973 | Harvey | 52/309 |

*Primary Examiner*—John E. Murtagh
*Attorney, Agent, or Firm*—W. G. Fasse; W. W. Roberts

[57] ABSTRACT

This modular building wall unit comprises a hard foam layer and a concrete layer intimately bonded to each other along an interface between the layers. A reinforcing wire mesh matt is embedded in the hard foam layer and reaches with anchoring elements into the concrete layer which may also have embedded therein a further wire mesh matt. The present units are cast in a mold by first keeping the mold horizontally and filling it partially with the hard foam. When the hard foam is sufficiently cured, the mold is brought into a substantially upright position, closed and filled with the concrete mix. Of course, a top portion is left open for the filling.

10 Claims, 2 Drawing Figures

MODULAR BUILDING WALL UNIT AND METHOD FOR MAKING SUCH UNIT

BACKGROUND OF THE INVENTION

The present invention relates to a modular building wall unit and a method for making such unit. Preferably, the present wall units are suitable as load supporting wall elements made of hard foam material and concrete.

Prior art wall elements are constructed in the form of sandwiches comprising three layers. One of these layers forming the outer surface of the element is made of cement bonded light weight structural materials which simultaneously may form a supporting surface for plaster or stucco work. In the alternative the outer layer is suitable for attachment thereto of wood paneling or the like. The intermediate layer of these prior art structural elements comprises either foamed or inserted insulating material. The third layer which is the inwardly facing layer usually comprises a panel of sheetrock or the like. The first mentioned outwardly facing layer usually comprises so called light weight concrete. Light weight concrete is known as a combination of porous mineral components bonded to each other by hydraulically effective bonding means, such as cement, whereby the structural components such as prefabricated concrete slabs or the like confine a certain proportion of hollow spaces. Slabs or plates of this so called light weight concrete have a weight ranging betwen about 0.8 to 1.4kg/dm$^3$. By employing a steam hardening or curing process the weight of such light weight structural elements may still further be reduced to about 0.45kg/dm$^3$.

The above mentioned intermediate layer of insulating material comprises, for example, foam materials of the polyurethane type which are covered up even before curing with the sheetrock panel, the outer surface of which provides a surface which may be painted or which is suitable for paper hanging.

A significant disadvantage of the prior art structural elements as described above is seen in that they are suitable only for insertion into a supporting frame structure because these elements of aerated concrete are practically not capable of taking up any practically useful statical loads.

The foregoing disadvantage has been recognized heretofore. Thus, German Patent Publication 2,145,978 discloses a sandwich type structural element which comprises an outer layer formed by a reinforced concrete slab or plate. The production of this type of element has the drawback that the reinforced concrete slab must be dry in order to provide the necessary bonding with the subsequently applied intermediate layer of foam material, such as polyurethane foam.

OBJECTS OF THE INVENTION

In view of the above, it is the aim of the invention to achieve the following objects singly or in combination:

to avoid the drawbacks of the prior art, more specifically to avoid the three layer type of sandwich construction and to provide a two layer structural element which may be used as a structural supporting element without the need for the use of a supporting frame structure;

to assure that the outwardly facing surfaces of the two layer structure are sufficiently smooth for the intended purposes of forming an outwardly facing surface and an inwardly facing surface in a building without the need for a subsequent working of the surfaces of the finished wall unit to provide said desired smoothness;

to combine a conventional concrete mixture with a so called hard foam having a specific weight within the range of about 20 to 80kg/m$^3$ and a compressive strength or crush resistance within the range of at least 1kg/cm$^2$ up to 300kg/cm$^2$;

to combine concrete mix with hard foam materials which are known as such and which have closed cells, relatively fine pores, as well as a temperature stability within a range of −200°C to about 120°C;

to combine in a structural unit a concrete mix and a foam material having good dielectric characteristics and which is resistant to gasoline, mineral oils, aliphatic hydrocarbons, non-concentrated acids, lyes, water and soil;

to employ for the purposes here disclosed a hard foam material which comprises within its structure fire-proof components or components which reduce the inflammability of the foam material;

to employ a foam material which is water repellent but at the same time has a good vapor diffusion factor, so that active breathing is possible, said vapor diffusion factor also permitting the covering of the surfaces of these wall units by means allowing for such active breathing;

to produce a two layer structural wall element in a mold in such a manner that both of its outwardly facing surfaces are sufficiently smooth; and to provide a two layer structural wall unit which in addition to being capable of taking up substantial loads, also provides an optimum heat insulation and protection against climatic influences.

SUMMARY OF THE INVENTION

According to the invention there is provided a structural wall unit comprising one layer of hard foam material having a compression strength in the range of 1 to 300kg/cm$^2$ and a further layer of concrete mix. The two layers are intimately bonded to each other and the foam layer is reinforced by a steel wire mesh mat embedded in the foam layer and reaching with anchoring elements into the concrete layer. Preferably, a further reinforcing steel wire mesh mat is also embedded in the concrete layer and the two mats may be interconnected by said anchoring means to form a reinforcing cage. The foam layer has an outer surface which is especially suitable to face outwardly when installed in a building so as to be exposed to the elements. The concrete layer also has an outwardly facing surface suitable for conventional interior decorating such as paper hanging or painting. Both outwardly facing surfaces are smooth so that subsequent working of these surfaces is substantially avoided according to the invention by forming these wall units in a mold which is first maintained in a horizontal position to receive the hard foam material. As soon as the hard foam material is sufficiently cured or hardened, the mold is closed and brought into a substantially vertical position, whereupon it is filled with the second layer formed by a suitable concrete mix.

The layer of hard foam material may initially be cast with a raised edge extending, as desired, all around the margin of the hard foam layer, whereby these raised edges and the hard foam layer form a lost casing, so to speak for the subsequently cast concrete layer filled into the space formed by said raised edges.

In the formation of the present structural units, the mold is first filled with a portion of the hard foam material, whereupon the reinforcing means such as a wire mesh mat is inserted. Thereafter, the remaining portion of the hard foam material is filled into the mold. In order to properly locate a further reinforcing means for the concrete layer, it is possible to provide hard foam support lugs protruding above the surface of the hard foam layer in predetermined locations over the entire surface of the hard foam layer. These lugs may have any suitable spacing from each other depending on the type of reinforcements to be embedded in the concrete layer.

Hard foam materials of polyurethane type reach their final material strength and density after a relatively short time, for example, 15 minutes at the most whereupon the concrete may already be poured into the mold without any damage to the foam layer.

Incidentally, the raised edges of the hard foam layer may be formed by inserting into the mold respective casing means such as cardboard strips or the like which may either be removed after the foam has set or which may form a lost casing which will remain in the final product. The raised edges may have a height corresponding to the entire width of the wall unit or these raised edges may have a height corresponding to a portion of the entire width.

It will be appreciated that the present wall unit is suitable to be used either with the hard foam layer facing outwardly to form the outer facade of a building or the concrete layer could face outwardly to form the outer building facade. In any event, the bond between the hard foam layer and the concrete layer is so intimate in structure that the sandwich construction employed heretofore is not neccesary.

The hard foam material, especially where it also covers the lateral sides of the concrete layer and the lateral sides of any openings in the structural units provides such a good insulation that condensation will not occur along the interface between the concrete layer and the hard foam material layer. The heat insulation is effective in both directions; namely, from inside the building outwardly and from the outside of the building inwardly.

BRIEF FIGURE DESCRIPTION

In order that the invention may be clearly understood, it will now be described, by way of example, with reference to the accompanying drawings, wherein:

FIG. 1 is a sectional view through a structural unit according to the invention still in the mold; and FIG. 2 is a sectional view through a structural unit according to the invention and removed from the mold.

DETAILED DESCRIPTION OF EXAMPLE EMBODIMENTS

Figure 1:
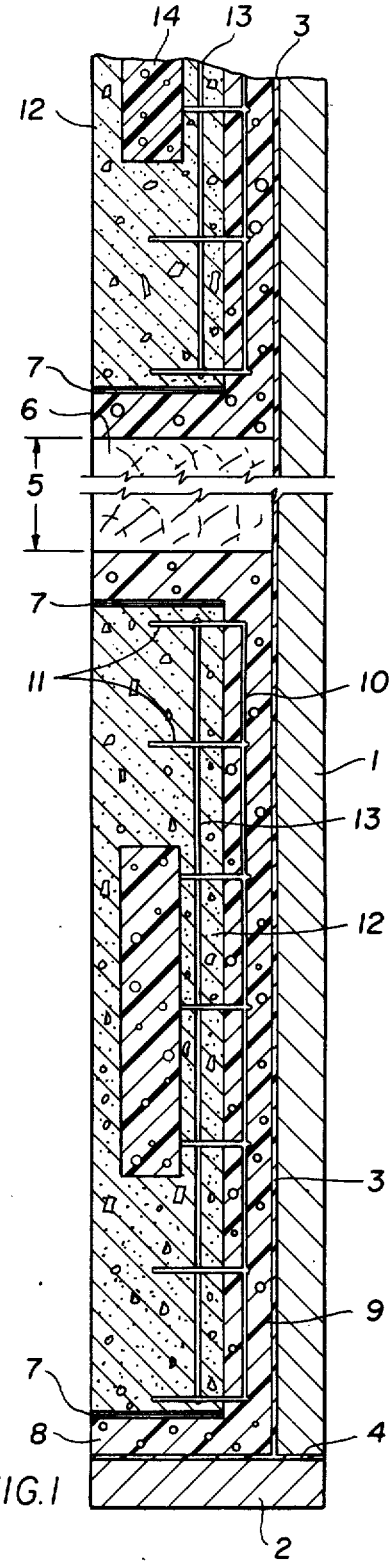

The mold shown in FIG. 1 comprises a base plate 1 surrounded by side walls 2. The mold may have dimensions to form a standardized structural wall unit having a width of 2.6 meters, a length of 4.8 meters and a thickness of 15 centimeters. Preferably the bottom of the mold and the inwardly facing surfaces of the mold side walls are lined with a sticking preventing material, for example, a Teflon layer 3. TEFLON is a registered trademark. A Teflon liner 4 is also provided along the inner surfaces of the side walls 2 of the mold.

A core 6 is inserted into the mold to provide openings in the wall unit, for example, door or window openings or the like. The core 6 may be located in any position within the mold. In order to raise the sides 8 of the hard foam layer 9 there are provided casing means 7, for example, cardboard strips or wooden moldings which may be either arranged as lost casing means, if desired, or the casing means 7 may be removed as soon as the hard foam of the raised sides 8 has sufficiently hardened.

Initially the mold is maintained in a horizontal position when the foam material for the foam layer 9 and the foam sides 8 is poured into the mold. First only a portion of the foam material is introduced into the mold to form a layer of for example, 2 centimeters. Incidentally, the foam may have a specific weight of about 50kg/m$^3$. After the first layer of hard foam material, such as polyurethane has been poured and before this layer is set, a reinforcing means such as a wire mesh mat 10 is placed onto the foam whereupon more hard foam material is introduced into the mold to embed the reinforcing mat 10 in the foam. The foam mat 10 is provided with anchoring means such as wire portions 11 bent out of the plane of the mat 10. The foam layer with the wire mat 10 embedded therein may have, for example, an entire height of 3.5cm and the raised sides 8 may have a height of, for example, 15cm. The pouring of the sides 8 is best accomplished when the layer 9 has slightly cured so as to prevent flowing of the foam material out of the lost casing means 7. Hardly any waiting time results in this respect because the setting takes place rather rapidly. Accordingly, the concrete layer 12 may be poured already a few minutes after the pouring of the foam layer. The conncrete mix for the layer 12 may be of any suitable mixing ratio, however, it has been found that the standard quality known under the term B-300 is quite suitable for this purpose. The mixing ratios for the so called B-300 mix are disclosed by the German Industrial Standards (DIN). Initially sufficient concrete mix is introduced into the mold to form a layer of about 2cm, whereupon, if desired, a further reinforcing steel wire mesh mat 13 may be placed onto the initial concrete mix layer. If desired, the anchoring means 11 may be connected to the further mat 13, thus forming a sort of cage with the first mentioned mat 10. After the embedding of the mat 13 light weight material cores 14 may be inserted in one or several positions of the wall unit. Thereupon the mold is completely filled and the top or outer surface of the concrete layer is screeded off against the edges or side walls of the mold. Thus, a smooth outwardly facing surface is provided for the concrete layer 12.

The light weight material cores 14 may, for instance, be made of Styropor (RTM) and preferably these cores will have dimensions of about 5 by 30cm. The thickness of the concrete layer between the cores 14 and the foam layer 9 will preferably be about 4cm.

As a preferred modification of the manufacturing process according to the invention, the molds may be closed by a cover member (not shown) as soon as the hard foam material 9 has sufficiently set, whereupon the molds are brought into a substantially upright position and filled with the concrete mix. In that instance, the upper side wall of the mold is wholly or partially removed in order to provide an inlet for the pouring of the concrete mix. Due to the contact of the concrete mix with the smooth surface of the cover member, the outwardly facing surface of the concrete layer 12 will have the desired smooth surface without any screeding.

A structural wall unit constructed as taught by the present invention, may have for example, standardized dimensions of 4.8m by 2.6m by 15cm. Such a unit, if it does not have any window or door openings may have, for example a weight of 4.7 to 4.9 tons and is thus easily transportable and movable with the conventional construction machinery, such as construction cranes and the like.

It will be appreciated that the weight of the individual structural units may be varied by the number and size of the light weight cores 14.

Figure 2:
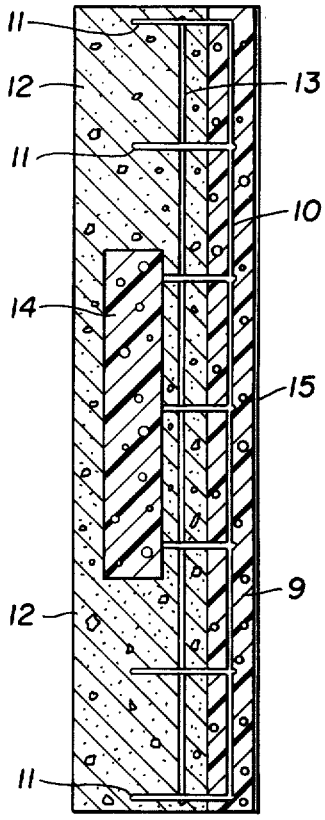

FIG. 2 illustrates a wall unit according to the invention after it has been removed from the mold. The same elements have been designated by the same reference numerals. The outwardly facing surface of the foam layer 9 is, for example, provided with a protective layer 15 such as a protective paint coating or the like which protects the hard foam material 9, for example, against ultraviolet radiation or other light radiation. Radiation protective means may also be mixed into the initial foam material 9, as is known in the art.

The protective layer 15 may also be provided by a structural means which defines the appearance of the outer surface of the foam layer 9. Such structural means would become an integral part of the wall unit and could, for instance be formed as decorative grids or shapes of aluminum of different colors and the like. Similarly, the outwardly facing layer of the concrete layer 12 may also be formed or decorated by structural means which become an integral part of the structural surface of the concrete layer 12. Such structural surface forming means will be inserted into the mold prior to the pouring of the foam layer and prior to the pouring of the concrete layer.

Although the invention has been described with reference to specific example embodiments, it will be appreciated, that it is intended to cover all modifications and equivalents within the scope of the appended claims.

What is claimed is:

1. A modular load bearing building wall unit comprising a hard foam layer having an inner surface and an outer surface, a concrete layer intimately bonded to said inner surface of said hard foam layer, a reinforcing wire mesh mat embedded in said hard foam layer and having wire portions extending from the plane of said first mat into said concrete layer for intimately bonding said foam layer to said concrete layer, said wire mesh mat being completely covered all around by said foam layer at both sides thereof, and core elements of a material lighter than the material of said concrete layer, said core elements being completely embedded in said concrete layer.

2. The building wall unit of claim 1, comprising a further wire mesh mat completely embedded in said concrete layer whereby said wire portions of said first mentioned wire mesh mat extend into said concrete layer beyond said second wire mesh mat.

3. The building wall unit of claim 1, further comprising radiation protection means on the surface of said hard foam layer.

4. The building wall unit of claim 1, wherein the outer surface of said hard foam layer constitutes a weather resistant surface.

5. The building wall unit of claim 1, further comprising surface structure forming means as an integral part of the outer surface of said hard foam layer and of said concrete layer.

6. The building wall unit of claim 1, wherein the sides of said concrete and foam layers away from the sides in contact with each other are smooth.

7. A modular load bearing wall unit comprising a hard foam form member forming a part of said wall unit and a concrete layer intimately bonded to said form member, said form member comprising a layer of hard foam material having rim portions extending from one surface at the edges thereof, a first wire mesh mat embedded in said layer of foam material and having wire portions extending from the plane of said first wire mesh mat through the surface from which said rim portions extend, said concrete layer being in intimate contact with said one surface substantially throughout its extent, whereby said wire portions extend thereinto for bonding said form member to said concrete layer, said concrete layer having a thickness equal to the height of said rim portions of said foam member, said first mesh mat being completely covered by the foam material of said form member at the other surface of said layer.

8. The building wall unit of claim 7, wherein said wall unit has openings extending completely therethrough, said form member having rim portions extending from said layer of foam material having a height equal to the thickness of said concrete layer and lining said opening.

9. The building wall unit of claim 7, further comprising lost casing molding strips between said rim portions and the adjacent sides of said concrete layer.

10. The building wall unit of claim 7, wherein the surfaces of said concrete layer and layer of said foam material opposite said one surface of said layer of foam material are substantially smooth.

* * * * *